US005137586A

United States Patent [19]

Klink

[11] Patent Number: 5,137,586

[45] Date of Patent: Aug. 11, 1992

[54] METHOD FOR CONTINUOUS ANNEALING OF METAL STRIPS

[76] Inventor: James H. Klink, 121 Marble Dr., Bridgeville, Pa. 15017

[21] Appl. No.: 636,675

[22] Filed: Jan. 2, 1991

[51] Int. Cl.[5] ..... C21D 1/76

[52] U.S. Cl. ..... 148/529; 266/44; 148/634; 148/644

[58] Field of Search ..... 148/16.7, 20.3; 266/44, 266/103, 111, 259; 431/12; 432/8, 59, 37

[56] References Cited

U.S. PATENT DOCUMENTS

| | | | |
|---|---|---|---|
| 2,529,689 | 11/1950 | Hess | 148/16.7 |
| 4,069,008 | 1/1978 | Bloom | 432/8 |
| 4,316,717 | 2/1982 | Thome | 148/128 |
| 4,440,583 | 4/1984 | Ikegami et al. | 148/128 |
| 4,588,378 | 5/1986 | Yamamoto et al. | 432/59 |
| 4,836,774 | 6/1989 | Harada et al. | 432/8 |

FOREIGN PATENT DOCUMENTS

| | | | |
|---|---|---|---|
| 53-037507 | 4/1978 | Japan | 148/16.7 |
| 57-158329 | 9/1982 | Japan | 266/111 |

OTHER PUBLICATIONS

"Convection Heat Transfer—Gas Streams-Jet Impingement", American Society of Mechanical Engineers, 1961 by Robert Gardon and John Corbonpue.

*Energy Management of Industrial Furnaces*, John Wiley, pp. 142-144, ISBN 89464-316-9, by Carol Cone, also pp. 78-79; 1988.

"High Performance Hydrogen Annealing Technology", *Iron and Steel Engineer*, Aug. 1988, pp. 43 and following, by Derek Powell.

"Design Installation and Operation of Wheeling-Nisshin's Aluminizing and Galvanizing Line", *Iron and Steel Engineer*, Nov. 1989 by Yoshio Hayashi and others.

"Heat Transfer Characteristics of Impinging Two Dimensional Air Jets", *Journal of Heat Transfer*, American Society of Mechanical Engineers, Feb. 1966, pp. 101-108 by Robert Garden and another.

*Primary Examiner*—R. Dean

*Assistant Examiner*—Margery S. Phipps

[57] ABSTRACT

An improved method of heat treating a continuous strip of metallic material of indeterminate length in a continuous annealing furnace. The furnace includes a heating section having a plurality of gas jet heaters and a cooling section having a plurality of gas jet coolers. The continuous strip is heated and cooled in the heating and cooling sections within predetermined selected temperature ranges for the strip, by convection and solely with mixtures of hydrogen and nitrogen gases impinged against both sides of the strip through the gas jet heaters and the gas jet coolers. The temperatures of the strips in the heating and cooling section are monitored. Temperatures are controlled by varying the ratios of the mixtures of the heating and cooling gases which achieves and maintains the predetermined selected temperature ranges for the strip in the heating and cooling chambers despite changes in operating conditions.

15 Claims, 3 Drawing Sheets

METHOD FOR CONTINUOUS ANNEALING OF METAL STRIPS

TECHNICAL FIELD OF THE INVENTION

The present invention relates to a method for heating and then cooling a strip of metallic material in a continuous annealing furnace. The heating and cooling rates are varied by the use of gas jets, in which the volumetric ratios of hydrogen and nitrogen supplied thereto are varied.

BACKGROUND OF THE INVENTION

Typically, a conventional furnace for continuous annealing of metal strips, such as cold rolled steel strips, is so constructed that such a strip is unreeled from a payoff reel and is introduced into the furnace via a cleaning tank and/or a burn-off chamber which preheats the strip, and in which rolling oils are removed. Thus, the strip is clean when entering the furnace via entry seal rolls located just ahead of a heating chamber. The furnace is provided with a plurality of rolls, which guide the strip through the furnace, as the strip is subjected to heating, holding, slow cooling and fast cooling. The heating temperatures and heating rate in the heating chamber, the holding time in a holding chamber, and the cooling rate and temperature in a cooling chamber are dependent upon the mechanical properties desired for the end product. Another type of strip annealing furnaces includes a heating section, a water quench, a reheating drawing section and a cooling section.

After a strip has been suitably annealed so as to achieve high tensile strength or other mechanical properties that may be desired, the strip may be used as is or may be further processed. Thus, for example, the annealed strip may be tin-plated in a separate, continuous, tin-plating line or galvanized in a zinc pot in line with the annealing furnace.

In the heating chamber of such a furnace, the strip is typically heated by radiant energy from radiant tubes. After leaving the heating chamber, the strip is held for the desired period of time at the required annealing temperature in a holding chamber with radiant tubes. After leaving the holding chamber, the strip is cooled in a cooling chamber, in which the strip may be slow cooled at a controlled rate by air tubes and then fast cooled by fast jet coolers. The strip is heated and cooled in a protective atmosphere consisting of a mixture of hydrogen and nitrogen with a low dew point to prevent oxidation within the furnace chambers. Typical atmosphere mixtures for carbon steel strip consist of about 5% by volume hydrogen and about 95% by volume nitrogen for steel to be tin plated and of about 25% by volume hydrogen and about 75% by volume nitrogen for steel strip to be galvanized. The heating chamber is divided into discrete zones of control. Each zone has several radiant tubes and a zone thermocouple, which is located between the radiant tubes and the strip. The zone thermocouple coacts with a process controller to adjust the heat output of the radiant tubes.

Typically, the heating zones are maintained at temperatures that are significantly higher than the required final strip temperature. For example, for commercial grades of carbon steel strip to be galvanized, the heating zones are maintained at about 1800° F. for a required final strip temperature of approximately 1280° F. During furnace operation, if the strip speed should slow down, the strip would be heated to a temperature that would be significantly higher than the required final strip temperature. Such overheating would adversely effect the mechanical properties of the strip. For proper mechanical properties, the time that the strip is held in the holding chamber varies with the metallurgical requirements of the final product. In some cases, the strip does not require a holding time. Furthermore, the cooling rates and final strip temperatures where the strip is discharged from the furnace depend upon the mechanical properties required for the final product.

SUMMARY OF THE INVENTION

The present invention provides an improved method of heat treating a continuous strip of metallic material of indeterminate length in a continuous annealing furnace. Such a strip is formed of successive welded lengths, which may vary in their mechanical and metallurgical properties. The furnace includes a heating zone or section having a plurality of gas jet heaters and a cooling zone or section having a plurality of gas jet coolers.

According to the improved method, the continuous strip is heated and cooled in the heating and cooling zones within predetermined selected temperature ranges for the strip, by convection and solely with mixtures of hydrogen and nitrogen gases impinged against both sides of the strip through the gas jet heaters and the gas jet coolers in those zones. The temperatures of the strip in the heating and cooling zones are monitored. Setting and adjusting the ratios of the mixtures of the heating and cooling gases achieves and maintains the predetermined selected temperature ranges for the strip in the heating and cooling zones despite changes in operating conditions including line speed and material gauge. In other words, adjusting and varying the ratios of the mixtures of the heating and cooling gases varies the rates of heat transfer between the gases and the strip in the heating and cooling zones, thereby to achieve and maintain the predetermined selected temperature ranges for the strip in the heating and cooling zones despite such changes.

The furnace may also include a holding zone or section having a plurality of gas jet heaters and being disposed between the heating and cooling zones. If a holding zone is included, the improved method may include heating the continuous strip in the holding zone within predetermined selected temperature ranges for the strip, by convection and solely with mixtures of hydrogen and nitrogen gases impinged against both sides of the strip through the gas jet heaters of the holding zone. If the temperature of the strip in the holding zone is monitored, adjusting and varying the ratio of the mixture of the heating gases in the holding zone achieves and maintains the predetermined selected temperature ranges for the strip in that zone.

The heat transfer rate may be additionally varied, as by adjusting the velocities of the hydrogen . and nitrogen mixtures impinged against the strip, or by adjusting the temperatures to which the hydrogen and nitrogen mixtures are heated or cooled prior to passing the mixtures through the gas jets. The hydrogen to nitrogen ratios may range from 5 to 95% hydrogen by volume and from 95 to 5% nitrogen by volume.

It is possible to increase the heat transfer rate by a factor of about four, in the mixtures impinged on the strip through at least some of the gas jet heaters and gas jet coolers, by increasing the hydrogen from about 10% to about 90% by volume in such mixtures and by decreasing the nitrogen from about 90% to about 10% by volume in such mixtures.

Preferably, the gas jet heaters and gas jet coolers are unit jet heaters and unit jet coolers respectively.

Desirably, the average heating temperature in the heating zone is slightly higher than the desired strip temperature, so that there would be minimal risk of overheating the strip if the strip speed should slow down. As an example, in the heating zone, the average heating temperature may be about 100° F. higher than the desired strip temperature.

These and other objects, features, and advantages of this invention will be apparent from the following description of a preferred mode for carrying out the improved method of this invention, with reference to the accompanying drawings.

BRIEF DESCRIPTION OF THE DRAWINGS

FIG. 3 also shows components for supplying mixed gases to the jet heater and for controlling the mixture of the supplied gases.

FIG. 5 also shows gas mixture supplying and controlling components associated with the jet cooler.

DETAILED DESCRIPTION OF PREFERRED MODE

Figure 1:
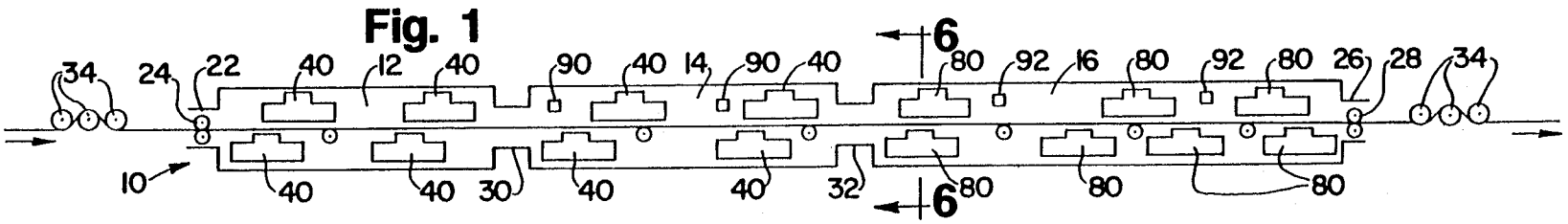
FIG. 1 is a diagrammatic representation of an annealing furnace, which includes a heating chamber with a plurality of jet heaters, a holding chamber with a plurality of jet heaters, and a cooling chamber with a plurality of jet coolers. The annealing furnace is useful for carrying out the improved method of this invention.
Figure 2:
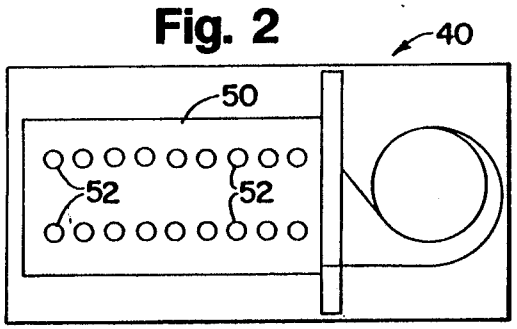
FIG. 2, on an enlarged scale, is a simplified, bottom plan view of one of the jet heaters associated with the heating and holding chambers of the annealing furnace.
Figure 3:
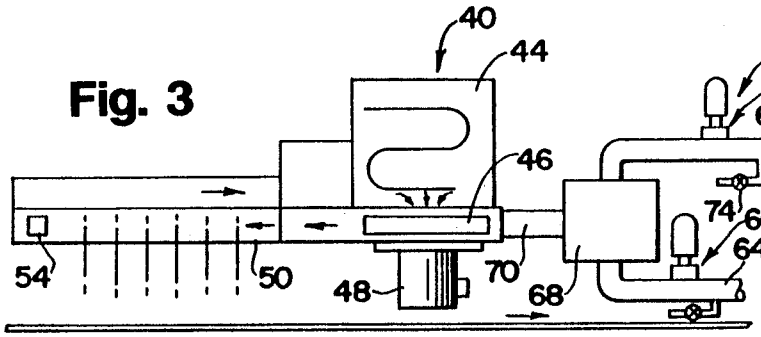
FIG. 3 is a simplified, semi-diagrammatic, cross-sectional view taken through the jet heater of FIG. 2.
Figure 4:
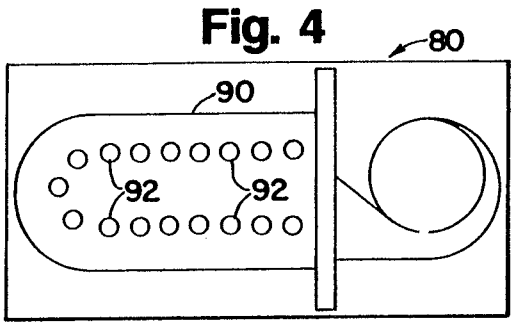
FIG. 4, on a similar scale, is a simplified, bottom plan view of one of the jet coolers associated with the cooling chamber of the annealing furnace.
Figure 5:
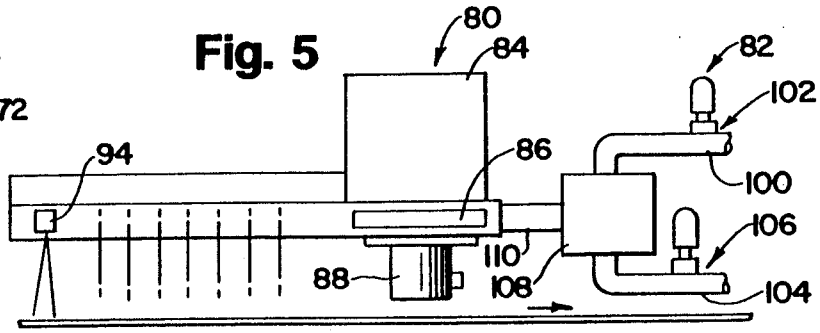
FIG. 5 is a simplified, semi-diagrammatic, cross-sectional view taken through the jet cooler of FIG. 4.

As shown diagrammatically in FIG. 1, an annealing furnace 10 is useful for continuous annealing of continuous metal strip, such as carbon steel strips welded end-to-end, by the improved method provided by this invention. The annealing furnace 10 is divided into a heating section or chamber 12, a holding section or chamber 14, and one or more cooling sections or chambers 16, one of which is shown and all of which may be vertically or horizontally arranged, or both. Each of the heating and holding chambers contains one or more unit jet heaters, as shown in FIGS. 2 and 3. Each of the cooling chambers contains one or more unit jet coolers, as shown in FIGS. 4 and 5. Although the sections or chambers may comprise the entire heating, holding and cooling sections, zones of those sections or chambers may be heated in accordance with this invention whereas other zones, particularly in retrofit furnaces, may be conventionally heated.

Figure 6:
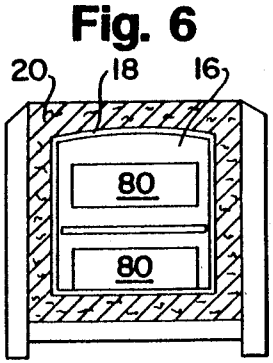
FIG. 6 is an enlarged, cross-sectional view taken along line 6—6 of FIG. 1, in a direction indicated by arrows.

The furnace chambers are lined with metallic enclosures, which are welded so as to be gas-tight. The metallic enclosures are backed with walls of insulating refractory material (which may be a conventional fibrous refractory material), and are totally enclosed in a structural steel outer casing. The inner metallic linings reduce the heat loss that would be normally encountered if hydrogen mixed with nitrogen or pure hydrogen were used as an atmosphere within unlined walls. As shown in FIG. 6, the cooling chamber 16 is defined by a metallic enclosure 18 backed by insulating walls 20.

The heating chamber 12 has an inlet vestibule 22, in which seal rolls 24 are operatively mounted. The final cooling chamber 16 can have an outlet vestibule 26, in which seal rolls 28 are operatively mounted. The heating, holding, and cooling chambers are connected to one another by tunnels, which are lined with gastight, welded, metallic enclosures backed by insulating refractory walls, and which are encased in a structural steel casing. As shown in FIG. 1, the heating chamber is connected with the holding chamber by a tunnel 30, and the holding chamber 14 is connected with the first of the cooling chambers 16 by a tunnel 32. In accordance with well known practices, the respective chambers may be vertically or horizontally arranged so that the strip or strips are fed in serpentine paths, over upper rolls and lower rolls.

The strips, such as the strip S shown in FIGS. 1, 3, and 5, are carried through the furnace 10 by rolls 34 driven by DC gear motors (not shown) in a known manner. The speed of these motors is set by an overall speed control mechanism (not shown) which controls all strip delivery and discharge equipment.

The annealing furnace 10 is pressurized by controlled mixtures of hydrogen and nitrogen gases fed to jet heaters and jet coolers to be later described. The volume of these gases is adjusted manually to maintain positive pressure in the total enclosure defined by the furnace 10. The pressurizing gases are discharged at the inlet vestibule 20, the outlet vestibule 24, or both.

By supplying a specific mixture of heated hydrogen and nitrogen gases to each of the jet heaters in the heating chamber 12, the heating rate is established so that the required strip temperatures is attained for the strip leaving the heating chamber and entering the holding chamber 14. The holding time can be effectively adjusted by setting the number of jet heaters used for heating and the number of jet heaters for holding. Indeed, in some instances the holding cycle may be eliminated by appropriately adjusting the time and temperatures of the heating cycle. With the present invention close control over heating by using more or less unit jet heaters and by the greater heat transfer efficiency achieved may make it possible, when desirable, to substantially eliminate the holding cycle altogether.

If a change in condition occurs, such as a change in strip grade or a change in strip gauge, each jet heater is adjusted to set the heating rate and the holding time appropriate for the transient condition. Thereupon each jet heater is reset for continuous operation with the strip grade and strip thickness present after the transient condition.

Each cooling chamber 16 contains a plurality of jet coolers to be later described. The jet coolers are set in an analogous manner so that the cooling rate can be varied for a change in transient condition, after which the jet coolers can be reset for continuous operation.

Figure 8:
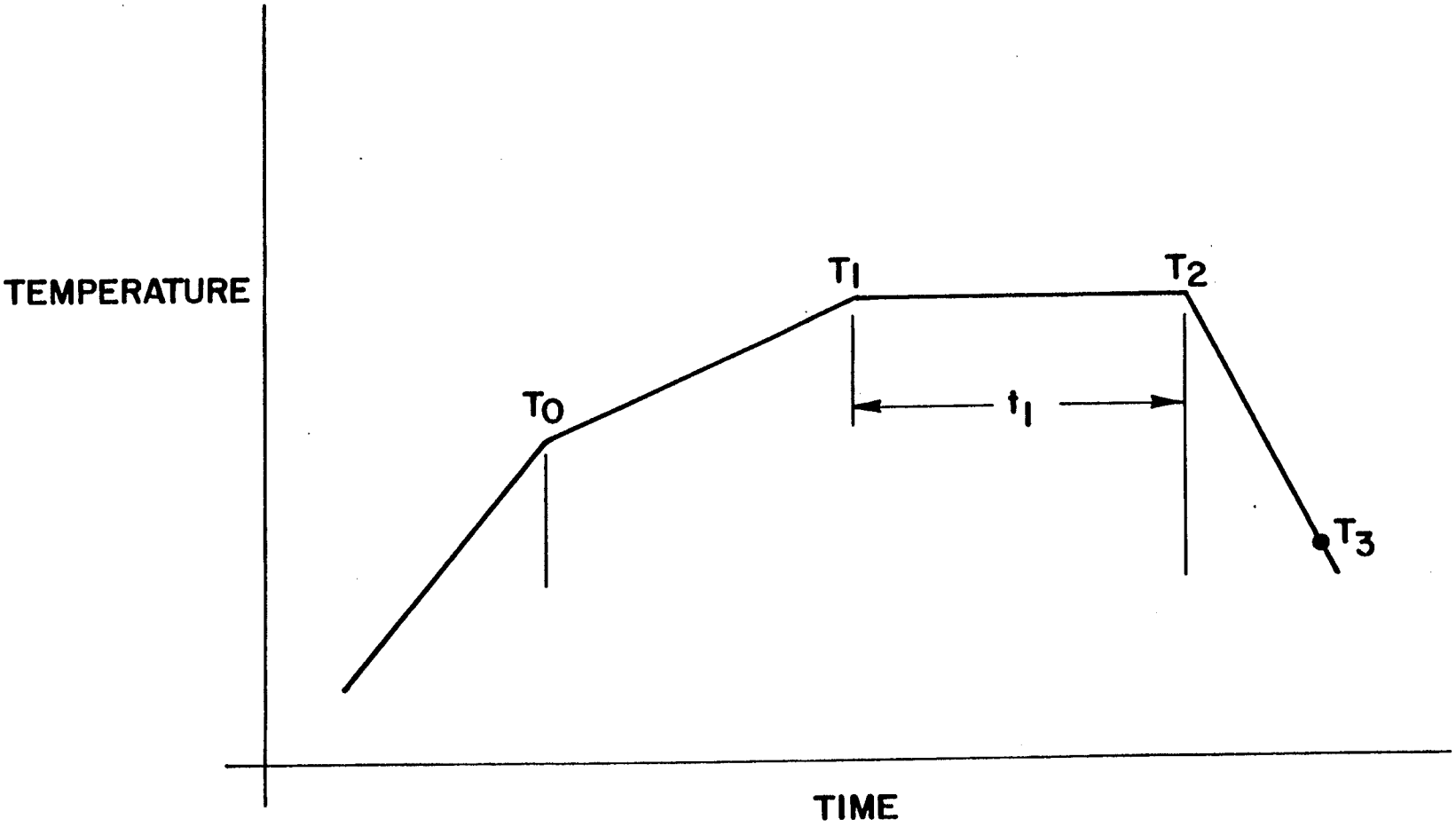
FIG. 8 is a diagram of a time versus temperature cycle exemplifying applications of the improved method of this invention.

As diagrammed in FIG. 8, the annealing furnace 10 can be operated with a time versus temperature cycle meeting any of a wide variety of strip grades and strip sizes. The curve to the left of $T_1$ from $T_o$ represents the heating cycle; from $T_1$ to $T_2$ represents the holding cycle; and from $T_2$ to $T_3$ represents the cooling cycle. $T_3$ represents a desired temperature of the strip exiting the cooling chambers. $T_o$ represents the temperature of the strip leaving the burn-off furnace, i.e., temperatures of the strip entering the heating chamber. If there is no burn-off furnace, $T_o$ represents the ambient temperature of the strip entering the heating chamber. An exemplary suitable exiting temperature is 800° to 850° F. when the strip is to be hot dip galvanized. Typically, a carbon steel strip is heated to a temperature from about 1250° F. to about 1450° F., which depends upon the end product and required metallurgical properties. The following table provides typical values for $T_0$, $T_1$, $t_1$, and $T_2$ for different steel grades:

| Typical Thermal Cycles (Strip Temperatures) | | | | |
|---|---|---|---|---|
| Grade | $T_0$ | $T_1$ | $t_1$ | $t_2$ |
| Commercial Grade | 1250° F. | 1300° F. | 0 sec. | 1300° F. |
| Deep Draw | 1250° F. | 1400° F. | 10 sec. | 1400° F. |

In the heating zone or chamber 12, and in the holding zone or chamber 14, the strip is heated within predetermined selected temperature ranges, by convection and solely with mixtures of hydrogen and nitrogen gases impinged against both sides of the strip through gas jet heaters, as the strip is fed through such chambers. The gas jet heaters are typically referred to as unit gas jet heaters.

As discussed above, a typical prior art furnace for continuous annealing of metallic strip utilizes radiation from radiant tubes. Electric heating elements may be used instead. The basic radiation heat transfer equation is $$q/a = hr\,(T_{furnace} - T_{strip}) = hr\,(T_f - T_s)$$

where hr is calculated using the Stephen-Boltzman constant $\alpha$ as follows:

$$hr = \alpha F_e F_a[(T_f + 460)^4 - (T_s + 460)^4)]/(T_f - T_s)$$

where hr is the radiation surface coefficient of heat transfer in Btu/hr-sq ft-deg F, where the Stephen-Boltzman constant $\alpha$ is 0.173 E-8 btu/hr-sq ft- deg $R^4$, where $F_e$ is a dimensionless emissivity factor which takes into account the departure of both surfaces from perfect blackness when refractory surfaces are present, and where $F_a$ is the exposure factor for radiant tubes in a refractory enclosure.

A theoretical example for a strip furnace can be found in Carol Cone *Energy Management of Industrial Furnaces*, John Wiley, page 142–144, ISBN 0-471-0637-2.

Practical field data on existing furnaces heated by radiant tubes result in a $F_eF_a$ factor of 0.30 to 0.35. This factor is calculated from the known heat flux and the furnace and strip temperatures. The field data correlate the theoretical calculations by Cone.

Convection heat transfer is correlated using the Nusselt (Nu) and Reynolds (Re) numbers (see Robert Gardon and John Cobonpue, "Convection Heat Transfer—Gas Streams—Jet Impingement," American Society of Mechanical Engineers). Their data were based on heated air. For other gases, the Prandtl number (Pr) is close to the same over the range of temperatures from 60° F. to 1800° F.

For convection heating or cooling, the basic heat transfer equation is $$q/a = hc\ LMTD$$

where q/a is the heat flux in Btu/hr-sq ft, where hc is the convection heat transfer coefficient in Btu/hr/sq ft/deg F, and where LMTD is the log mean temperature difference defined by $$[(T_j - T_{s\,out}) - (T_j - T_{in})]/\ Ln\ [(T_j - T_{s\,out})/(T_j - T_{s\,in})]$$

where $T_j$ is the temperature of the jet stream, where $T_{s\,out}$ is the temperature of the strip leaving the chamber, where $T_{s\,in}$ is the temperature of the strip entering the chamber, and where Ln is the natural logarithm.

By comparing q/a=hc LMTD for heating by convection to $q/a = hr\,(T_f - T_{s\,ave})$ for heating by radiation, one can compare the effective heat fluxes or heat transfer rates for heating or cooling of similar strips. Using the properties of mixtures of hydrogen and nitrogen, one finds that the heat flux using convective heating is three to four times the heat flux using radiant heating, making heating and cooling substantially more effective and efficient and providing closer control and more rapid control and change than with radiant heating processes.

A unit jet heater 40 exemplifying the gas jet heaters is shown in FIGS. 2 and 3. A gas-supplying apparatus 42 associated with the unit jet heater 40 is shown in FIG. 3.

The unit jet heater 40 comprises a heat exchanger 44 and a recirculating fan 46, which is powered by an alternating current motor 48. The heat exchanger 44 uses a fossil fuel, such as natural gas, to heat the mixture of gases drawn through a plenum 50. The motor 48 is controlled by a variable frequency controller (not shown) which varies the speed (rpm) of the motor 48. The fan 46 is arranged to draw both recirculated gases from the heating chamber and additional "make-up" gases from the supply lines into the plenum 50, in which the drawn-in gases are heated indirectly by the heat exchanger 44. The fan 46 is arranged to direct the heated gases at a controlled temperature through multiple holes or nozzles 50 in the plenum, against the metallic strip. The controlled temperature is set by a temperature controller (not shown) receiving signals from a thermocouple 54 located in the plenum. The mixed gases are directed against the strip at a controlled velocity, which is determined by the speed (rpm) of the motor 48 powering the fan 46.

As shown in FIG. 3, the gas-supplying apparatus 42 is associated with one or more of the unit jet heaters 40 and comprises a hydrogen supply line 60 with a flow control valve 62, a nitrogen supply line 64 with a flow control valve 66, a mixing chamber 68 connected to the supply lines 60, 64, and an exiting mixed gases supply line 70 connected to one or more of the unit jet heaters 40. A hydrogen bypass line 72 with a manual valve 74 is piped around the flow control valve 62 in the hydrogen supply line 60. A nitrogen bypass line 72 with a manual valve 74 is piped around the flow control valve 66 in the nitrogen supply line 64. These bypass lines can be manually adjusted to supply a mixture of hydrogen and nitrogen at a pressure sufficient to maintain a positive pressure in annealing furnace 10. The supply lines 60, 64, are connected to suitable sources (not shown) of hydrogen and nitrogen. The flow control valves 62, 66, are arranged to be remotely controlled to deliver hydrogen and nitrogen at a controlled volumetric ratio, thereby to set the heat transfer rate by establishing the heat transfer properties and heat content of the mixed gases.

In the cooling chambers 16, gas jet coolers cool the strip as the strip is fed therethrough. The cooling rate and the discharge temperature are controlled by varying the mixtures of hydrogen and nitrogen gases supplied from gas-supplying apparatus to the jet coolers.

A unit jet cooler 80 exemplifying the gas jet coolers of the cooling chambers 16 is shown in FIGS. 4 and 5. A gas-supplying apparatus 82 associated with one or more of the unit jet coolers 80 is shown in FIG. 5.

The jet cooler 80 comprises a water-to-gas heat exchanger 84 and a recirculating fan 86, which is powered by an alternating current motor 88. The heat exchanger 84 is arranged to cool the recirculated gases drawn through a plenum 90 by a recirculating fan 86. The motor 88 is controlled by a variable frequency controller which changes the speed (rpm) of the AC motor 88. Setting the speed of the motor 88 controls the flow rate of the recirculated gases. The fan 86 is arranged to draw gases from the cooling chamber and recirculate those with make-up gases and to direct the mixed gases against the strip in the cooling chamber 16 through multiple holes or nozzles 92 in the plenum 90.

As shown in FIG. 5, the gas-supplying apparatus 82 associated with one or more of the jet coolers 80 is similar to the gas-supplying apparatus 42 shown in FIG. 3 and described above.

In the jet cooler 80, the temperature of the mixed gases is established to be approximately equal to the temperature in the heat exchanger 84. Since the water flow is relatively constant, the cooled gas temperature is essentially a function of the speed (rpm) of the fan 86, as set by the speed (rpm) of the motor 88. For a given operating condition, the temperature of the cooled gases in the plenum 90 is controlled by a thermocouple 94 in the plenum 90. The thermocouple 126 adjusts a temperature controller (not shown) which adjusts the speed (rpm) of the motor 88.

Figure 7:
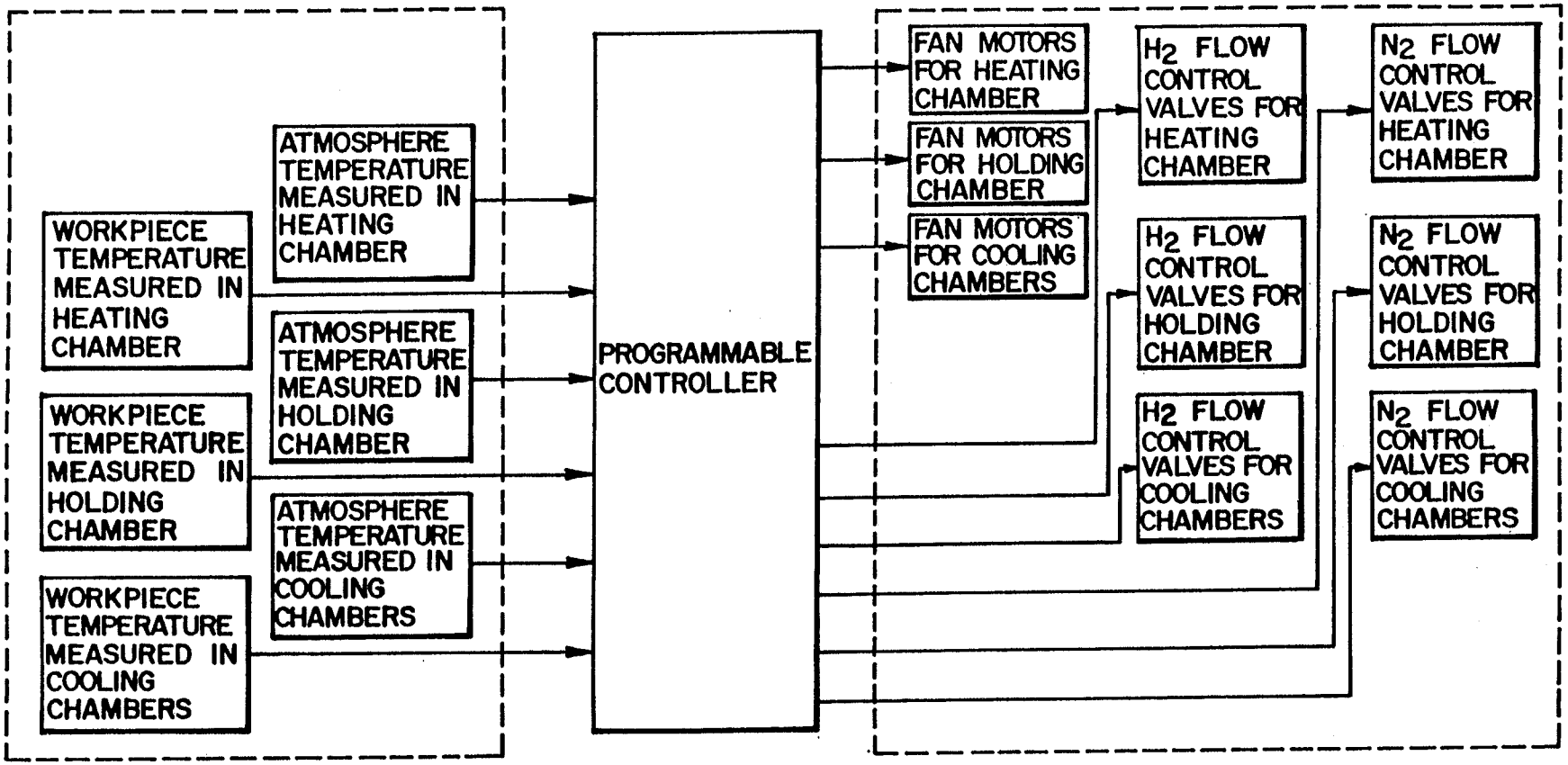
FIG. 7 is a flow diagram of a programmable controller receiving data signals from various sensors and sending control signals to the control components of FIGS. 3 and 5 and to controllers associated with fan drive motors on the jet heaters and jet coolers.

A programmable controller 120 is connected to preset the mixed gas temperatures in the jet heaters 40 in the heating chamber 12, in the jet heaters 40 in the holding chamber 14, and in the jet coolers 80 in the cooling chambers. The temperatures are preprogrammed in computer software controlling the controller 120 and are based on the time versus temperature cycle required for the specific metallurgical analysis of the strip to be processed. Functions of the controller 120 are diagrammed in FIG. 7.

Adjustment of the hydrogen and nitrogen mixture for each unit jet heater 40 and for each unit jet cooler 80 is preprogrammed in the programmable controller and determines the heating and cooling rates as well as the holding time in the holding chamber 14.

Temperatures measured by strip-temperature measuring devices 90 in the holding chamber 14 and by similar devices 92 in the cooling chambers 16 are compared by the programmable controller to the preprogrammed required temperatures. If the strip temperature in the holding chamber 14 is too high or too low, the heating rate is adjusted by changing the hydrogen and nitrogen mixture in selected jet heater units 40 in the heating chamber 12. The annealing furnace 10 can be operated in such a manner that the average temperature of gases directed by the jet heaters in the holding chamber 12 is slightly above the required strip annealing temperature in the holding chamber 14. Thus, as an example, the average temperature of such gases may be about 100° F. above the required strip annealing temperature.

In some cases, the heating rate is adjusted by the programmable controller so that at least some of the ratios of the hydrogen and nitrogen mixtures passing through the gas jet heaters 40 in the heating section 12, the holding section 14, or both are different. Similarly, the cooling rates may be adjusted by the programmable controller so that at least some of the ratio of such mixtures passing through the gas jet coolers 80 are different. Thus, the annealing process may be precisely controlled at different locations within the heating, holding, and cooling sections.

In accordance with the present invention, substantially increased tonnage may be produced in a given furnace as compared to conventional furnaces using radiant tubes. Typical furnaces are designed to accommodate four foot wide strip. However, when narrower strip, such as two foot or three foot strip, is to be heat treated, the production (tonnage per hour) from a radiant heated furnace for a given gauge strip is reduced by approximately the ratio of the width of the strip. That is because the heat input to the strip from the radiant heater units to the strip cannot be changed. Thus, narrower strip cannot be speeded up, as compared to full width strip, and the tonnage output possible is reduced for narrower strip in a radiantly heated annealing furnace.

It will be apparent that with the strip of a given gauge at a given speed only so much heat may be transferred into the strip by the radiant heaters in the furnace per unit of strip width. In a conventional furnace with radiant heaters sized for producing strip of a base size of 0.030 inch thick by 48 inches wide at the rate of 40 tons per hour, and having a maximum line speed of 500 feet/minute for strip 0.015 inch thick, for commercial grade strip the following tables are exemplary:

| | SPEED (FEET/MINUTE) | | |
|---|---|---|---|
| STRIP THICKNESS | 24" STRIP WIDTH | 36" STRIP WIDTH | 48" STRIP WIDTH |
| 0.060" | 125 | 125 | 125 |
| 0.030" | 250 | 250 | 250 |
| 0.015" | 500 | 500 | 500 |

| | PRODUCTION RATE (TONS/HOUR) | | |
|---|---|---|---|
| STRIP THICKNESS | 24" STRIP WIDTH | 36" STRIP WIDTH | 48" STRIP WIDTH |
| 0.060" | 20 | 30 | 40 |
| 0.030" | 20 | 30 | 40 |
| 0.015" | 20 | 30 | 40 |

However, with the use of the jet heaters and jet coolers of the present invention, the heat transfer (q/a) can be increased by increasing the ratio of the hydrogen/nitrogen mixture, as well as by the velocity of the mixture as it impinges against the strip. As such a narrower strip may be heated more rapidly, assuming a given heat output availability for a particular furnace. Thus, a narrower strip may be speeded up in the furnace, as compared to a wider strip, while maintaining desired treating temperatures, unlike conventional radiant heater furnaces. In a furnace with jet heaters and coolers in accordance with this invention, also sized for producing strip of a base size of 0.030 inch thick by 48 inches wide at a rate of 40 tons per hour, and having a maximum line speed of 500 feet/minute for strip 0.015 inch thick, and using a heat transfer coefficient (hc) of 30 Btu/hr/sq ft/° F. for commercial grade strip, the following tables are theoretically exemplary:

| | SPEED (FEET/MINUTE) | | |
|---|---|---|---|
| STRIP THICKNESS | 24" STRIP WIDTH | 36" STRIP WIDTH | 48" STRIP WIDTH |
| 0.060" | 250 (60) | 168 (40) | 125 (30) |
| 0.030" | 500 (60) | 333 (40) | 250 (30) |
| 0.015" | 500 (30) | 500 (30) | 500 (30) |

The production line speed is increased as compared to the conventional furnace line speed by increasing the heat transfer coefficient (hc) above the base design of 30 by increasing the hydrogen to nitrogen ratios. The hc factor is shown parenthetically in the above example, and results in increased production for reduced width strip, shown as follows.

| | PRODUCTION RATE (TONS/HOUR) | | |
|---|---|---|---|
| STRIP THICKNESS | 24" STRIP WIDTH | 36" STRIP WIDTH | 48" STRIP WIDTH |
| 0.060" | 40 | 40 | 40 |
| 0.030" | 40 | 40 | 40 |
| 0.015" | 40 | 40 | 40 |

For conventional furnaces it is necessary to slow down the line to increase the holding times necessary for strip products requiring such. In accordance with the present invention holding times can be increased or decreased by adjustment of the heat transfer rates for the heating and cooling sections by increasing or decreasing the hydrogen/nitrogen ratios. Thus line speed can be maintained (and the production rate maintained) by increasing the rate of heat transfer in the heating and cooling sections, thus getting up to the holding temperature more rapidly, and facilitating cooling down from the holding temperature more rapidly, and all without overheating or overcooling the strip.

Further, the thermal inertia of the annealing furnace 10 in accordance with the present invention is low compared to the thermal inertia of the typical radiant tube-heated furnace. Because its thermal inertia is low, the annealing furnace 10 will exhibit heat transfer changes responding rapidly to changes in the gauge of the strip or to changes in the metallurgical properties of the strip being processed. The annealing furnace 10 can be operated so that less strip is rejected because of improper annealing due to the thermal inertia. The mixed gas temperature changes rapidly to the required annealing temperature so that the line can be stopped without overheating or overcooling of the strip.

It will be apparent from the foregoing that the use of hydrogen/nitrogen convection heating and cooling of the strip and the variation in the velocity of the impingement of the gas mixtures on the strip makes it possible to adjust and maintain desired strip temperatures much more rapidly and efficiently and to use much lower temperatures in the heating and holding chambers than is possible with radiant heating systems.

Various modifications may be made in the improved method described above without departing from the scope and spirit of this invention.

What is claimed is:

1. A method of heat-treating in a continuous annealing furnace a continuous strip of metallic material of indeterminate length and formed of successive welded lengths which may vary in their properties, said furnace including a heating zone having a plurality of gas jet heaters and a cooling zone having a plurality of gas jet coolers, comprising the steps of heating and cooling said continuous strip in said heating and cooling zones to target temperature patterns for said strip, by convection with mixtures of gases consisting of hydrogen and nitrogen that are impinged against both sides of said strip through said gas jet heaters and gas jet coolers, monitoring the temperatures of said strip in said heating and cooling zones, and setting and adjusting ratios of the mixtures of the gases to control the heat transfer rate and to achieve and maintain the target temperature patterns for said strip in said heating and cooling zones, and further adjusting the ratios to control the temperature patterns in response to changes in line speed and material gauge.

2. The method of claim 1, and wherein said annealing furnace also includes a holding zone having a plurality of gas jet holding zone heaters, said holding zone being disposed between said heating and cooling zones, and the further step of heating said continuous strip in said holding zone to a target holding zone temperature pattern for said strip, by convection with the mixtures the gases that are impinged against both sides of said strip through said gas jet holding zones heaters, monitoring the temperature of said strip in said holding zone, and setting and adjusting ratios of the mixtures of the gases in said holding zone to achieve and maintain the target temperature pattern for said strip in said holding zone.

3. The method of claim 1 in which the heat transfer rate is additionally varied by adjusting velocities at which of the mixtures of the gases are impinged by the gas jet heaters and gas jet coolers against said strip.

4. The method of claim 1 wherein the mixtures of the gases are heated and cooled, respectively, and in which the heat transfer rate is additionally varied by adjusting the temperatures to which the mixtures of the gases are heated or cooled prior to discharging the mixtures from the gas jet heaters and gas jet coolers.

5. The method of claim 1 in which the ratios of the gases range from 5 to 95% hydrogen by volume and from 95 to 5% nitrogen by volume.

6. The method of claim 1 in which the heat transfer rate is increased by a factor of about four in said mixtures of the gases that are impinged through at least some of said gas jet heaters and gas jet coolers, by increasing the hydrogen from about 10% to about 90% by volume therein and by decreasing the nitrogen from about 90% to about 10% by volume therein.

7. The method of claim 1 and comprising the step of supplying some of the gas jet heaters with ratios of the gases which are different from the ratios supplied to other of the gas jet heaters.

8. The method of claim 1 and comprising the step of supplying some of the gas jet coolers with ratios of the gases which are different from the ratios supplied to other of the gas jet coolers.

9. A method of heat-treating in a continuous annealing furnace a continuous strip of metallic material of indeterminate length and formed of successive welded lengths which may vary in their properties, said furnace including a heating zone having a plurality of gas jet heaters and a cooling zone having a plurality of gas jet coolers, comprising the steps of p1 heating and cooling said continuous strip in said heating and cooling zones to target temperature patterns for said strip, by convection with mixtures of gases consisting of hydrogen and nitrogen that are impinged against both sides of said strip through said gas jet heaters and gas jet coolers, monitoring the temperatures of said strip in said heating and cooling zones, and setting and adjusting ratios of the mixtures of the gases to control the heat transfer rate of the mixtures and to vary the rates of heat transfer between said mixtures of the gases and said strip in said heating and cooling zones, thereby to achieve and maintain said target temperature patterns for said strip in said heating and cooling zones, and further adjusting the ratios to control the temperature patterns in response to changes in line speed and material gauge.

10. A method of increasing the rate of production of narrow strip in a continuous annealing furnace having heating and cooling sections and which was designed to anneal a wide strip at a given production rate for a given gauge, comprising the steps of p1 providing a continuous annealing furnace with a heating zone having a plurality of gas jet heaters and a cooling zone having a plurality of gas jet coolers, heating and cooling said continuous strip in said heating and cooling zones to target temperature patterns for said strip, by convection with mixtures of gases consisting of hydrogen and nitrogen that are impinged against both sides of said strip through said gas jet heaters and gas jet coolers, monitoring the temperatures of said strip in said heating and cooling zones, and setting and adjusting ratios of the mixtures of the gases to control the heat transfer rate and to achieve and maintain the target temperature patterns for said narrow strip in said heating and cooling zones in response to a reduction in the material width of the strip below the width for which the annealing furnace was designed, thereby the permit substantially more rapid movement of a narrower strip through the furnace than was possible for a wider strip of the same gauge and to improve the production rate for the narrow strip.

11. The method of claim 10, and wherein said annealing furnace also includes a holding zone having a plurality of gas jet holding zone heaters, said holding zone being disposed between said heating and cooling zones, and the further step of heating said continuous strip in said holding zone to a target holding zone temperature pattern for said strip, by convection with the mixtures of the gases that are impinged against both sides of said strip through said gas jet holding zone heaters, monitoring the temperature of said strip in said holding zone, and varying the mixtures of the gases in said holding zone to achieve and maintain the target temperature pattern for said strip in said holding zone.

12. The method of claim 10 in which the heat transfer rate is additionally varied by adjusting velocities at which the mixtures of the gases are impinged by the gas jet heaters and gas jet coolers against said strip.

13. The method of claim 10 wherein the mixtures of the gases are heated and cooled, respectively, and in which the heat transfer rate is additionally varied by adjusting the temperatures to which the mixtures of the gases are heated or cooled prior to passing the mixtures through the gas jet heaters and gas jet coolers.

14. The method of claim 10 in which the ratios of the gases range from 5 to 95% hydrogen by volume and from 95 to 5% nitrogen by volume.

15. The method of claim 10 in which said heating and cooling zones are the heating and cooling sections of the continuous annealing furnace.

* * * * *

UNITED STATES PATENT AND TRADEMARK OFFICE

CERTIFICATE OF CORRECTION

PATENT NO. : 5,137,586

DATED : August 11, 1992

INVENTOR(S) : James H. Klink

It is certified that error appears in the above-identified patent and that said Letters Patent is hereby corrected as shown below:

Column 5, line 25, "$t_2$" should be --$T_2$--;

Column 6, line 16, "$T_{in}$" should be --$T_{s\ in}$--; and

Column 8, line 6, insert --40-- after "heaters";

Column 11, line 13, delete "pl";

Column 11, line 37, delete "pl";

Column 12, line 9, delete "the" and substitute --to--;

Column 12, line 21, delete "the" (both occurrences);

Column 12, line 21, insert --only-- after "mixtures";

Column 12, line 21, insert --hydrogen and nitrogen-- before "gases"; and

UNITED STATES PATENT AND TRADEMARK OFFICE

CERTIFICATE OF CORRECTION

PATENT NO. : 5,137,586
DATED : August 11, 1992
INVENTOR(S) : James H. Klink

It is certified that error appears in the above-indentified patent and that said Letters Patent is hereby corrected as shown below:

Column 12, line 22, delete "that are"--.

Signed and Sealed this

Nineteenth Day of October, 1993

*Attest:*

Bruce Lehman

BRUCE LEHMAN

*Attesting Officer*

*Commissioner of Patents and Trademarks*